US006338644B1

(12) United States Patent
Fritzinger et al.

(10) Patent No.: US 6,338,644 B1
(45) Date of Patent: Jan. 15, 2002

(54) SEALED MULTIPLE-CONTACT ELECTRICAL CONNECTOR

(76) Inventors: Daniel D. Fritzinger, 11917 Saint Joe Rd., Grabill, IN (US) 46741; Stephen R. Whitt, P.O. Box 264, Burr Oak, MI (US) 49030

( * ) Notice: Subject to any disclaimer, the term of this patent is extended or adjusted under 35 U.S.C. 154(b) by 0 days.

(21) Appl. No.: 09/591,704

(22) Filed: Jun. 9, 2000

(51) Int. Cl.[7] ..... H01R 13/56

(52) U.S. Cl. ..... 439/445; 439/519; 439/651

(58) Field of Search ..... 439/274–279, 439/932, 936, 319–522, 638, 650–651, 655, 658; 174/71, 77 R, 138 F

(56) References Cited

U.S. PATENT DOCUMENTS

| | | | | |
|---|---|---|---|---|
| 2,888,662 A | | 5/1959 | Hammell | |
| 3,065,448 A | | 11/1962 | Hopkins et al. | |
| 3,530,429 A | | 9/1970 | Scheller | |
| 3,601,751 A | | 8/1971 | Pauza | |
| 3,783,440 A | | 1/1974 | Karube et al. | |
| 3,796,987 A | | 3/1974 | Kinkaid et al. | |
| 3,827,007 A | | 7/1974 | Fairbairn et al. | |
| 3,936,131 A | | 2/1976 | Durand | |
| 3,998,518 A | | 12/1976 | Mathe | |
| 4,017,141 A | | 4/1977 | Bury et al. | |
| 4,346,959 A | | 8/1982 | Daugherty et al. | |
| 4,371,227 A | | 2/1983 | Yosimura | |
| 4,390,231 A | | 6/1983 | Plyler et al. | |
| 4,472,017 A | | 9/1984 | Sian | |
| 4,588,242 A | | 5/1986 | McDowell et al. | |
| 4,693,767 A | | 9/1987 | Grzanna et al. | |
| 4,830,628 A | * | 5/1989 | Dyson et al. | 439/579 |
| 4,857,007 A | * | 8/1989 | Michaels et al. | 439/273 |
| 5,137,478 A | | 8/1992 | Graf et al. | |
| 5,207,603 A | | 5/1993 | Peloza | |
| 5,226,837 A | | 7/1993 | Cinibulk et al. | |
| 5,278,354 A | | 1/1994 | Lhomme | |
| 5,298,300 A | | 3/1994 | Hosoi et al. | |
| 5,382,171 A | | 1/1995 | Hofmann et al. | |
| 5,470,622 A | | 11/1995 | Rinde et al. | |
| 5,489,223 A | | 2/1996 | Faje et al. | |
| 5,561,273 A | | 10/1996 | Yamanashi | |
| 5,626,479 A | | 5/1997 | Hughes | |
| 5,800,188 A | | 9/1998 | Barber et al. | |
| 6,048,224 A | | 4/2000 | Kay | |

OTHER PUBLICATIONS

Cover and pp. 8 and 9 of Tap USA catalog (1997) No month.

* cited by examiner

*Primary Examiner*—Lincoln Donovan
(74) *Attorney, Agent, or Firm*—Price, Heneveld, Cooper, DeWitt & Litton

(57) ABSTRACT

An environmentally protected, substantially sealed connector for attachment to a cable having a plurality of electrical conductors which are terminated at an end thereof with a contact, including a housing having a floor with a plurality of apertures therethrough arranged in a predetermined pattern and a backshell extending from the floor of the housing and encompassing the extended axes of the apertures, the backshell having at least one bead portion protruding from an outer surface of the outer backshell and extending at least partially around the backshell. A plurality of electrical contacts are disposed within the housing, each of the electrical contacts having a portion extending through one of the apertures and adapted to mate with one of the contact-terminated electrical conductors. Each of the electrical contacts has a locking member for retaining the associated contact in a fixed relationship to the floor. An overmold extends from and is molded about an exterior of the backshell to couple the overmold and backshell together. A portion of the overmold engages the bead in retaining relationship to augment the connection between the overmold and the backshell. The overmold extends axially away from the backshell and is preferably molded directly in place encompassing and securely coupled to an exterior of the cable of electrical conductors.

29 Claims, 4 Drawing Sheets

SEALED MULTIPLE-CONTACT ELECTRICAL CONNECTOR

RELATED APPLICATION

This application is related to U.S. application Ser. No. 08/948,340, filed Oct. 9, 1997, now U.S. Pat. No. 6,048,224, issued Apr. 11, 2000, which is commonly owned herewith and hereby incorporated by reference.

BACKGROUND OF THE INVENTION

The present invention relates to electrical connectors, and more particularly to vehicle mounted, environmentally protected exterior connectors which are substantially sealed from the elements.

Motor vehicles are often outfitted with an exterior multiple-conductor electric cable and associated connector or outlet to facilitate the towing of general purpose trailers, other motor vehicles, recreational vehicles, trailerable homes, or the like. One of the requirements of towing the trailers or vehicles is that, depending upon the configuration of the trailer or vehicle being towed, electrical signals to energize brake lights, running lights, turn signal lights, and provide power for various accessory devices must be transmitted from the towing vehicle to the towed trailer or vehicle. To accomplish this, electrical conductors which are typically housed in a sheath as a cable are routed to the rear of the vehicle and terminate at a connector mounted at or below the rear bumper of the towing vehicle. The connector has an internal contact configuration which is typically a standard throughout the industry to facilitate the connecting of an oppositely configured connector and associated cable which is part of the towed vehicle or trailer.

The externally mounted connector of the towing vehicle is typically mounted at or below rear bumper level, and is therefore subject to substantial environmental exposure which includes water, dust, snow, road salts, and the like. Such environmental exposure tends to corrode, short-circuit, and otherwise degrade the conductivity of electrical connections and thus diminish the operational capability of the connector. Prolonged environmental exposure can even result in the failure of the electrical connection, thus interrupting the electrical power and signals being transmitted to the towed trailer or vehicle. The disruption of signals and power to functions such as brake lights, signal lights etc., poses a serious safety concern to the operator of the vehicle and other motorists, and the provision of effective environmentally protected connectors has posed a problem for the manufacturers as well as users of such connectors.

The industry and using public have a need for a cable-connector combination which will reliably deliver electrical signals and electric power to a towed vehicle or trailer when used in the typical environmental conditions of road travel has long-term reliability, and which nonetheless is comparatively easy and economical to manufacture with consistent quality.

SUMMARY OF THE INVENTION

One aspect of the present invention is an environmentally protected connector of a sealed or substantially sealed character for attachment to a cable having a plurality of electrical conductors where each conductor is terminated at an end thereof with a contact. The connector includes a housing having a floor with a plurality of apertures therethrough arranged in a predetermined pattern. A backshell extends from the floor of the housing and encompasses the extended axes of the apertures, the backshell preferably having at least one bead portion protruding from an outer surface of the backshell and extending at least partially around the backshell. A plurality of electrical contacts are disposed within the housing, each of the electrical contacts having a portion extending through one of the apertures and adapted to mate with one of the contact-terminated electrical conductors. Each of the electrical contacts has a locking member for retaining the electrical contacts in a fixed relationship to the floor. An overmold extends from and is molded annularly about an extended portion of the backshell, a portion of the overmold extending over and engaging the bead. The overmold is also adapted to encompass the outer sheath or exterior of the cable of electrical conductors.

Another aspect of the invention is a connector shell for attachment to a cable having a plurality of electrical conductors. The connector shell includes a housing having a floor which has a plurality of apertures therethrough, arranged in a predetermined pattern where the apertures are adapted to receive electrical contacts therethrough. A backshell extends from the floor of the housing and encompasses the extended axes of all of the apertures and has at least one bead portion protruding from an outer surface. The bead extends at least partially around the outer surface. An overmold extends from and is molded about an exterior of the backshell to couple the overmold and backshell together. A portion of the overmold engages the bead portion in a retaining relationship to augment the connection between the overmold and the backshell. The overmold is adapted to encompass an exterior portion of the cable of electrical conductors.

Yet another aspect of the invention is an environmentally protected connector for attachment to a cable having a plurality of electrical conductors where each conductor is terminated at an end thereof with a contact. The connector includes a housing having a floor and walls with an upper edge where the walls define a central cavity. The upper edge defines an opening to the cavity, and a flange extends laterally from the walls proximate to the upper edge. The floor has a plurality of apertures therethrough in a predetermined pattern. A cover encloses the cavity opening and is pivotally mounted to the flange. An edge of the cover defines a circular recess about a periphery of the cover. A biasing member cooperates with the flange and the cover to bias the cover toward a closed position. A resilient member retained within the recess is biased against the upper edge when the cover is in the biased-closed position. A backshell extends from the floor of the housing and encompasses the extended axes of the apertures. The backshell has at least one bead portion protruding from an outer surface and extending at least partially therearound. A plurality of electrical contacts are disposed within the housing, each of the electrical contacts having a portion extending through one of the apertures and mated to one of the electrical conductors. The portion extending through the aperture has a locking tab for retaining its respective contact in a fixed relationship to its corresponding aperture. An overmold extends at least from the bead of the outer backshell to an exterior of the cable encompassing the electrical conductors for insulating and isolating the contacts and the conductors from the environment.

Still another aspect of the invention is an environmentally protected connector for attachment to a cable having a plurality of electrical conductors where each conductor is terminated at an end thereof with a contact. The connector includes a housing having a floor and walls with an upper edge where the walls define a central cavity. The upper edge defines an opening to the cavity, and a flange extends laterally from the walls proximate to the upper edge. The floor has a plurality of apertures therethrough in a predetermined pattern. A cover encloses the cavity opening and is pivotally mounted to the flange. An edge of the cover defines a circular recess about a periphery of the cover. A biasing member cooperates with the flange and the cover to bias the cover toward a closed position. A resilient member retained within the recess is biased against the upper edge when the cover is in the biased closed position. A backshell extends from the floor of the housing and encompasses the extended axes of the apertures. The backshell also has at least one bead portion protruding from an outer surface and extends at least partially around the backshell. A plurality of electrical contacts are disposed within the housing. Each of the electrical contacts has a portion extending through one of the apertures and further includes a locking tab for retaining the contact in a fixed relationship to its corresponding aperture. The plurality of electrical conductors are terminated with spade-type contacts which are mateably connected to the contact portions. An overmold is molded onto the backshell and extends at least from the bead of the backshell to the exterior of the cable encompassing the electrical conductors. These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
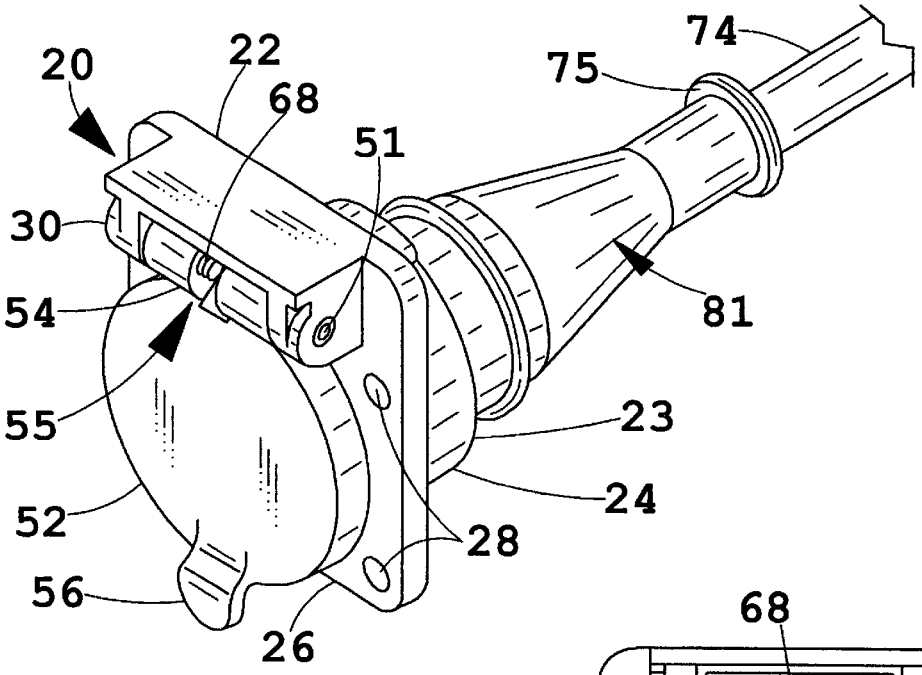
FIG. 1 is a perspective view of an environmentally sealed connector embodying the present invention, wherein an overmold extends from the backshell of the connector to the conductor cable.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. In addition, the term "sealed" as used herein is used in a relative rather than absolute sense, and should be so understood.

Turning to the drawings, FIGS. 1–6 show an environmentally protected, sealed connector 20, which is one of the preferred embodiments of the present invention, and illustrates its various components.

Figure 3:
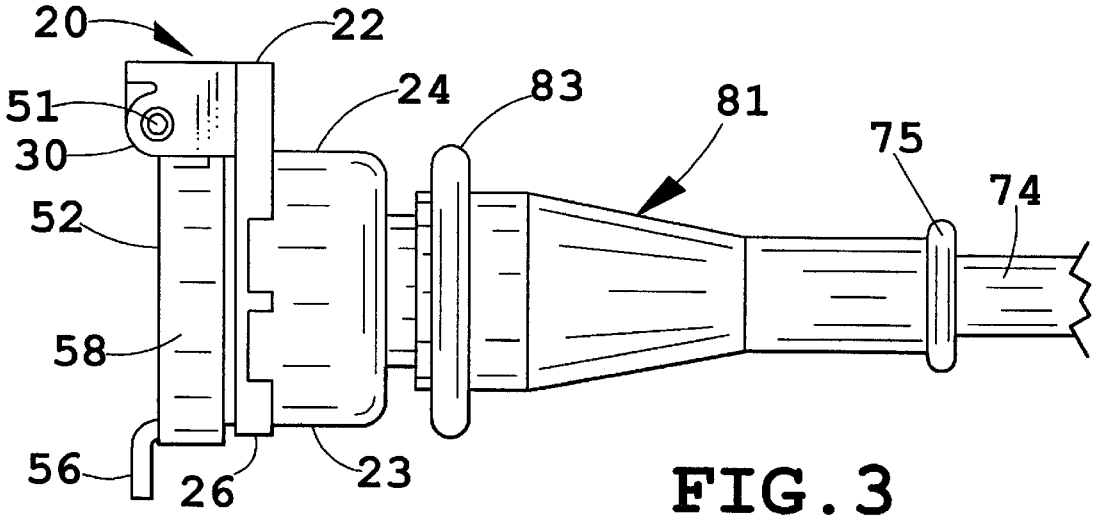
FIG. 3 is a side elevational view of the connector shown in FIG. 1, terminated to the electric cable.
Figure 5:
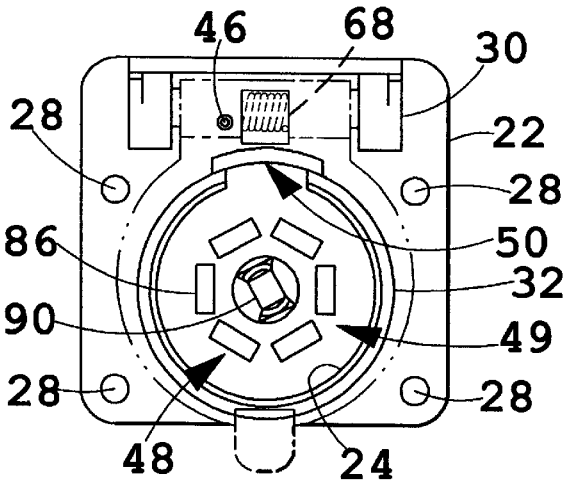
FIG. 5 is a front view of the connector shown in FIG. 1, with the cover removed and showing the contacts arranged inside the connector cavity.

The general configuration of the connector, most easily seen in FIGS. 1 and 3, includes a connector shell 22 which is generally comprised of a housing 23 having a rectilinear flange 26 and cover 52 disposed at one end thereof. In the preferred embodiment, housing 23 and cover 52 are formed from a moldable resin by known molding techniques. In another preferred embodiment, the housing 23 is made of a glass-filled polypropylene for making the housing strong and rigid. Flange 26 has a plurality of holes 28 proximate a periphery of flange 26 and extending therethrough for mounting connector 20 to a vehicle structure (not shown). Flange 26 has a fixed hinge 30 proximate to one edge thereof and in which rotatable hinge portion 54 of cover 52 is pivotally received and affixed thereto using hinge pin 51. Rotatable hinge portion 54 has a slot 55 therethrough wherein a biasing member 68 is disposed. In the preferred embodiment, biasing member 68 is a coiled torsion spring which is retained in place by hinge pin 51. Torsion spring 68 has a first free end (not shown) which is disposed in retaining hole 46 (FIG. 5) in flange 26. A second free end (not shown) of spring 68 bears against cover 52 in such a manner as to bias cover 52 toward a closed position to cover cavity opening 49 (FIG. 5). Cover 52 has a thumb tab 56 disposed substantially opposite from rotatable hinge portion 54 to aid a user to overcome the biasing force of spring member 68 to rotate cover 52 to an open position wherein cavity opening 59 is exposed.

Figure 6:
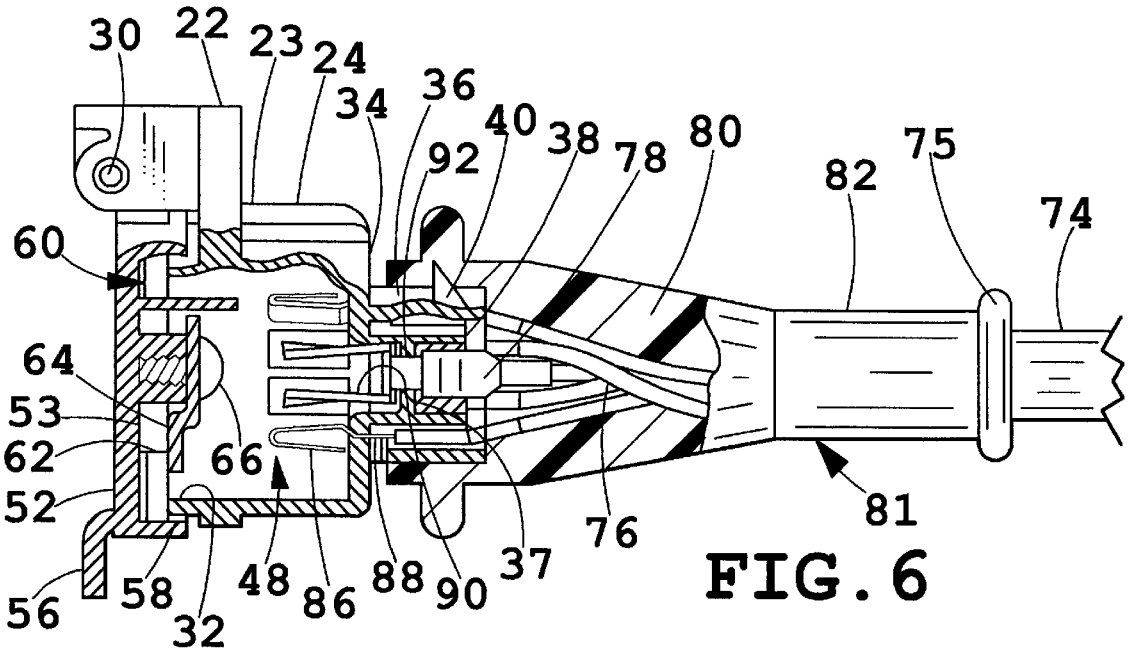
FIG. 6 is an enlarged, fragmentary, cross-sectional view of the connector showing the contacts extending through the housing floor and connected to the conductors of the electrical cable with the overmold extending thereover.

Housing 23 further includes walls 24 which extend from a floor 34 to form cavity 48 (FIGS. 5 and 6). In the preferred embodiment, walls 24 comprise a cannularly configured wall 24. An overmold 81 extends from the rear side of floor 34 to and over the sheath or outer covering of cable 74, to environmentally shield the interface of connector shell 22 and wire cable 74. Although the overmold 81 is shown as having a basically smooth outer surface, the overmold could also have a circumferentially ribbed surface.

Referring to FIGS. 3 and 6, cover 52 in the preferred embodiment includes a lip 58 extending rearwardly and around the periphery of cover 52. Lip 58 in combination with bottom surface 53 of cover 52 defines a recessed portion 60 of cover 52. A resilient annular member 62 is disposed within recessed portion 60 and is retained therein by retainer 64 which, in turn, is fastened to cover 52 by screw 66. In use, when cover 52 is moved into its closed position by biasing member 68, annular lip 58 extends around the outside of the end edge 32 of housing 23 and resilient member 62 bears directly against end edge 32. In this manner cavity 48 is both shielded and effectively sealed from the environment when connector 20 is not interconnected with a mating plug. In either the open or closed position of cover 52, an outwardly projecting top flange 21 and side flanges 21A provide a partial cover or shield for hinge 30 and the entrance to cavity 48.

FIGS. 4–8 disclose additional features of housing 23. While walls 24 of housing 23 are generally cannularly shaped in the preferred embodiment, a keying slot 50 (FIG. 5) is provided at an upper portion of cannular wall 24. Keying slot 50 functions to properly align mating terminals of a mating connector (not shown) with contacts 86 and 90 of connector 20 when the mating connector is plugged into the latter in use. Floor 34 has a plurality of apertures 44 therethrough (FIGS. 4, 6, 7, and 9) which in the preferred embodiment are rectilinear in shape and have a substantially greater length than width. Apertures 44 are generally arranged in annular fashion about the central axis of cannular wall 24 and may comprise any desired number, a total of six apertures 44 being shown for purposes of illustration. An additional central aperture 42 extends through floor 34 and is disposed near the center of floor 34. Those skilled in the art will appreciate that this particular geometric arrangement of apertures serves to configure connector 20 in a manner which conforms to an industry standard for connectors utilized to distribute electrical power and signals from a towing vehicle to a towed vehicle or trailer, but other such aperture configurations for alternate connector applications are possible. A central portion 37 of floor 34 may be disposed out of the plane of floor 34 to accommodate electrical contacts of a different configuration than accommodated by apertures 44, as discussed in greater detail below.

Figure 2:
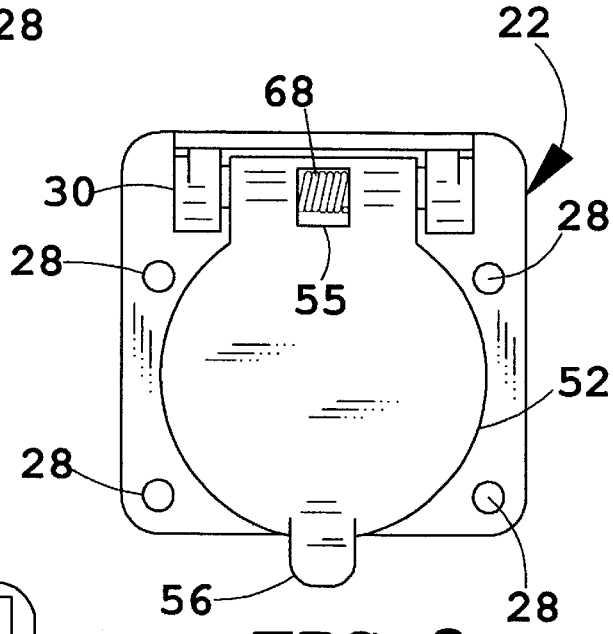
FIG. 2 is a front view of the connector shown in FIG. 1, showing the cover and mounting flange.
Figure 4:
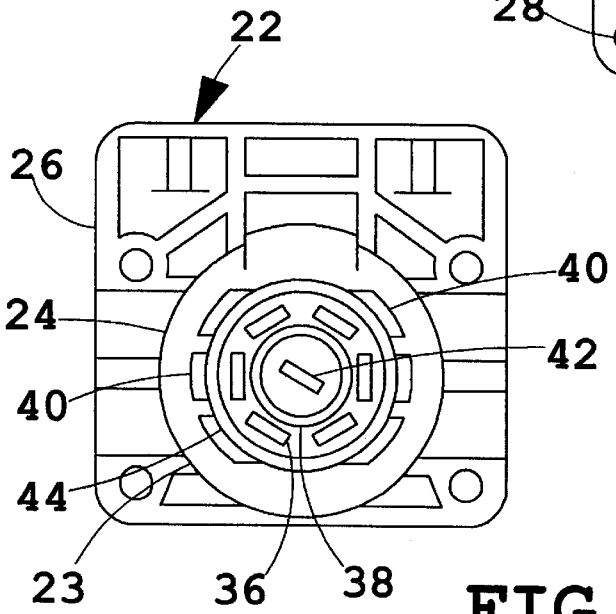
FIG. 4 is a rear view of the connector shell showing the apertures in the floor of the connector housing.
Figure 8:
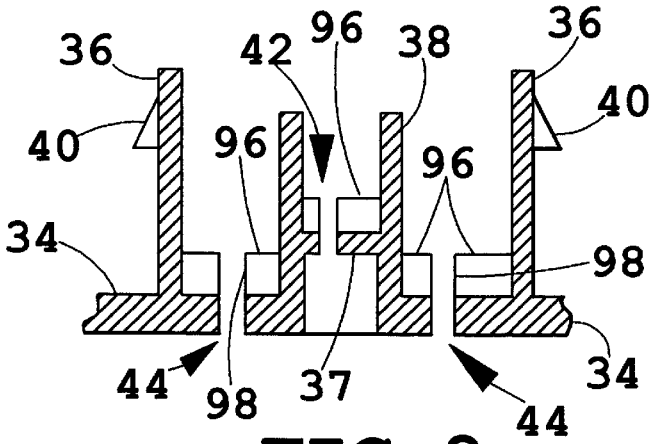
FIG. 8 is a fragmentary sectional view taken along the plane VIII—VIII of FIG. 7.

In the preferred embodiment, housing 23 has a cannularly shaped outer backshell 36 (FIGS. 4, 6, and 8) extending rearwardly from floor 34 substantially coaxial with cannular wall 24. Outer backshell 36 has a diameter sufficiently large enough to encompass the extended axes of apertures 42 and 44. Outer backshell 36 has at least one raised bead portion 40 protruding from an outer surface of the outer backshell 36 and extending circumferentially at least partially around the outer surface of backshell 36 (two axially aligned such bead portions, each extending part way around backshell 36 being shown; FIGS. 2, 4, and 8). The bead portion(s) 40 are preferably barblike like in shape, as shown, but could be more rounded or have other configurations as well. An inner backshell 38 also extends from floor 34 and encompasses central portion 37 of floor 34 and central aperture 42. Inner backshell 38 functions to isolate aperture 42 and its associated electrical contact 90 received therein from apertures 44 and their associated contacts 86 received therein.

Figure 9:
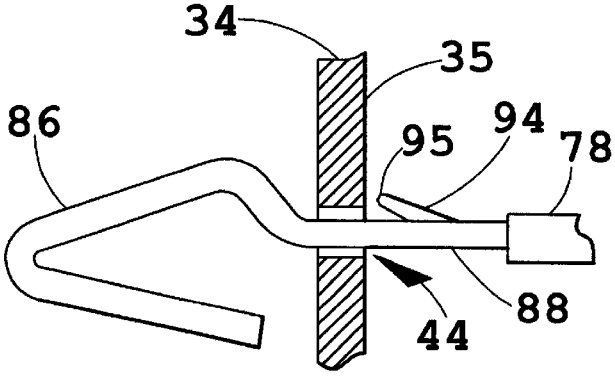
FIG. 9 is an enlarged view of a contact extending through the floor of the housing showing the locking tab holding the contact in a fixed relationship to the housing floor.

As shown in FIGS. 5, 6, and 9, electrical contact 90 and a plurality of electrical contacts 86 are inserted through apertures 42 and 44, respectively, to present an annular array disposed about a central electrical contact 90 for interconnection with a correspondingly arranged mating plug. Those skilled in the art will appreciate that the contact configuration as presented within cavity 48 of housing 23 is necessarily dictated by the contact configuration of the plug to be mated with connector 20, and vice versa. The portions of the electrical contacts within cavity 48 can be either male or female; however, a male portion 88 of contact 86, as most clearly seen in FIG. 9, extends through aperture 44 in floor 34; similarly, a portion 92 of contact 90 extends through central floor portion 37. Contact portion 88 is generally in the form of a rectilinear blade which is marginally smaller than aperture 44 to facilitate the extension of portion 88 through aperture 44. Portion 88 also incorporates a locking member 94 to retain electrical contact 86 in a fixed relationship with floor 34. In the preferred embodiment, locking member 94 comprises a locking tab which is a cantilevered tab attached at one end to portion 88 having a free end 95 which is displaced out of the plane of portion 88. As portion 88 is extended through aperture 44, the sides of aperture 44 flexibly displace cantilevered locking tab 94 to substantially coincide with the plane of portion 88 until free end 95 becomes disposed beyond outer floor surface 35. When portion 88 is fully extended through floor 34, free end 95 of locking tab 94 is disposed beyond the plane of outer surface 35 of floor 34, whereupon free end 95 of locking tab 94 springs back to its normal position out of the plane of portion 88. Free end 95 is thus disposed marginally outside of aperture 44 and bears against outer surface 35 of floor 34, thereby preventing the extraction of electrical contact 86 from floor 34 to maintain contact 86 in a fixed relationship to floor 34.

Referring now to FIG. 6, cable 74 has a plurality of electrical wires or conductors 76 housed therein. Each of conductors 76 have a spade-type terminal 78 secured thereto in electrically conductive relation. Spade-type terminals 78 are well-known in the art. Each of conductors 76 terminated with a spade terminal 78 is connected to portion 88 of contact 86 or portion 92 of contact 90 in a female-male fashion thereby providing an electrically conductive path from conductors 76 to contacts 86 and 90.

Figure 10:
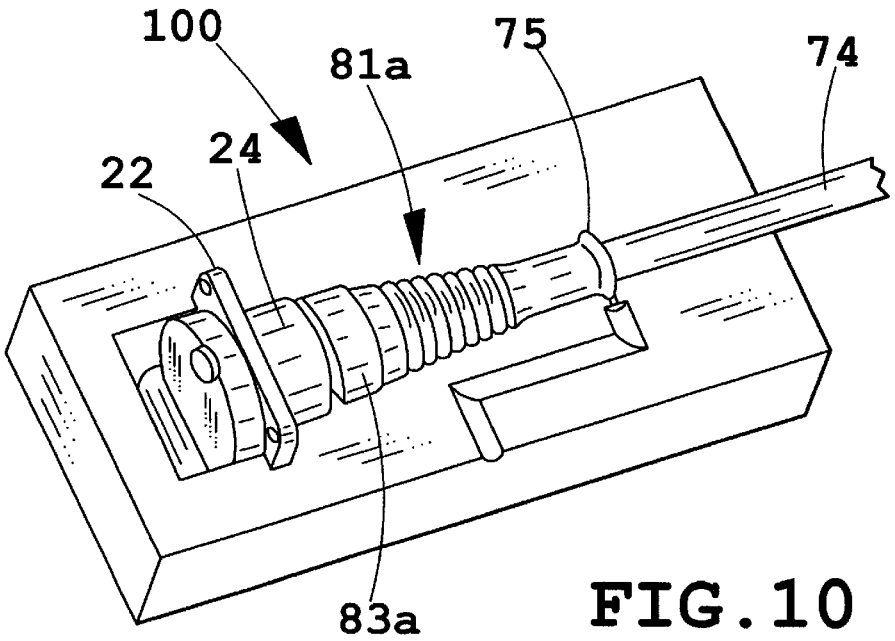
FIG. 10 is an overhead perspective view showing the lower half of the mold with a completed overmolded connector shown in its molding position.

As noted above and as further shown in FIG. 6, the overmold 81 extends from an outer surface of the outer backshell 36 to an external portion (e.g., outer sheath) of wire cable 74. Beads 40 of the preferred embodiment (shown in FIGS. 7 and 8) project radially outwardly from the outer surface of the outer backshell 36. As the overmold 81 is molded onto the outer backshell 36, the overmold 81 conforms to and fits contiguously around beads 40 (FIG. 6), thereby forming an external enlargement 83 (FIG. 3) or 83*a* (FIG. 10). With the overmold 81 molded over and closely conforming to the external geometry of the outer backshell 36 and beads 40, beads 40 function to prevent the inadvertent withdrawal of overmold 81 from the exterior of the outer backshell 36. The close-fitting nature of the overmold 81 around the outer backshell 36 and the outside of wire cable 74 also functions to firmly and positively connect backshell 36 and cable 74 together, and the flow of molding material into the voids inside cavity 48 isolates contact portions 88, spade terminals 78 and the adjacent portions of conductors 76 from the environment and from any short-circuiting or the like. The overmold 81 substantially fills all of the adjacent or proximate voids within the outer backshell 36, inner backshell 38 and cable 74. The overmold 81 therefore also functions to isolate aperture 42 and its associated electrical contact 90 received therein from apertures 44 and their associated contacts 86 received therein. Preferably, the overmold 81 is a flexible polyvinyl-chloride (PVC) plastic (e.g., durometer 60–70, Shore A) that is injection-molded around the outer backshell 36 of the housing 23 and the outside of the wire cable 74. Therefore, when the outer cover of cable 74 is made of PVC, the overmold 81 bonds to it to create a strong mechanical attachment and corresponding environmental seal.

As shown in FIG. 6, the injected material forming overmold 81 enters the inside of outer backshell 36 and inner backshell 38, and is present on both sides of the central floor portion 37, having flowed there during the injection molding process. This seals all voids or gaps between the housing 23 and the terminals 78. The amount of overmold material 81 flowing into the central floor portion 37 can be controlled by the pressure under which it is forced into the injection mold and by the injection duration, as well as by controlling the viscosity of the overmold material 81 injected into the mold. When the overmold material is injected slowly, it will first surround the cable 74 and the outer backshell 36, and then enter the outer backshell 36, the inner backshell 38 and the central floor portion 37. When the injection parameters of overmold 81 are suitably controlled, the overmold material will only flow into the front part of the central floor portion 37. The overmold 81 will therefore hold the contact portions 88 in the proper position in the outer backshell 36, the inner backshell 38 and the housing 24.

Figure 7:
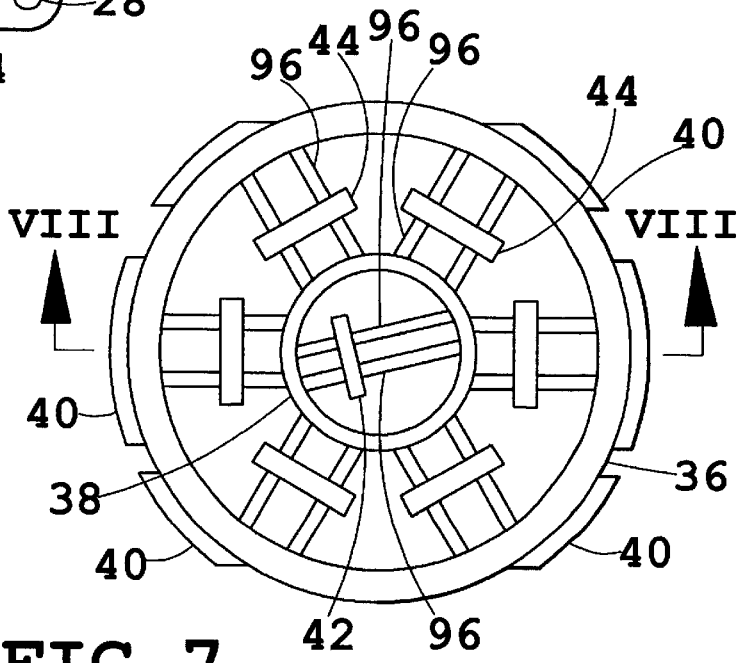
FIG. 7 is an enlarged view of the connector backshell area of FIG. 4, showing the ribs extending from the floor of the housing for stabilizing the contacts.

FIGS. 7 and 8 illustrate additional preferred features of the backshell area of housing 23. Since the thickness of floor 34 is relatively small with respect to the length of electrical contacts 86 and portion 88 extending through apertures 44, there is minimal support for maintaining contacts 86 substantially perpendicular to floor 34. To provide the required support to maintain contact 86 substantially perpendicular to floor 34, ribs 96 are provided which extend from floor 34 and are attached to the outer backshell 36. One or more ribs 96 are disposed at either side of apertures 44 and 42, with each rib 96 having a rib edge 98 which substantially coincides with a marginal edge of apertures 44 or 42. Rib edges 98 in combination with the marginal sides of apertures 42 and 44 function to maintain portions 88 and 92 of electrical contacts 86 and 90 substantially perpendicular to floor 34 and thus provide stable, well-positioned contacts 86 and 90 to engage with those of a mating plug (not shown). In the preferred embodiment, two ribs 96 are disposed along each side of each aperture 44 and 42. The outer backshell 36 and inner backshell 38 may also have radial walls extending radially from the inner backshell 38 to the outer backshell 38 between adjacent apertures 44 in order to protect adjacent contacts 86.

The environmentally protected or sealed connector 20 is preferably made by first molding the connector shell 22 and then pressing the contacts 86 into the slots 44 in the connector shell 22. The cable 74 is then cut to length, a desired portion of its outer sheath is removed to expose a length of the conductors 76, and a desired length of the outer insulation of conductors 76 is stripped, whereupon the exposed, individual conductors 76 are secured to terminals 78. The terminals 78 of the conductors 76 are then engaged with a corresponding contact 86 which has been inserted through the slots 44 of the connector shell 22. The connector shell 22 and the cable 74 assembly are then placed into the lower half 100 of a vertical, injection mold, as shown in FIG. 10. The operator of the mold closes the mold to seal around both the connector shell 22 and the cable 74, thereby creating a pocket from the end of the cable 74, across the individual conductors 76 and terminals 78 and up into the connector shell 22. The fluent molding material is then injected into the mold to fill this pocket, and it flows over the outside of cable 74, over and around the conductors 76, the terminals 78 and into the central portion 37 of the floor 34 of the connector shell 22 to seal the gap between the connector shell 22 and the terminals 78.

Figure 11:
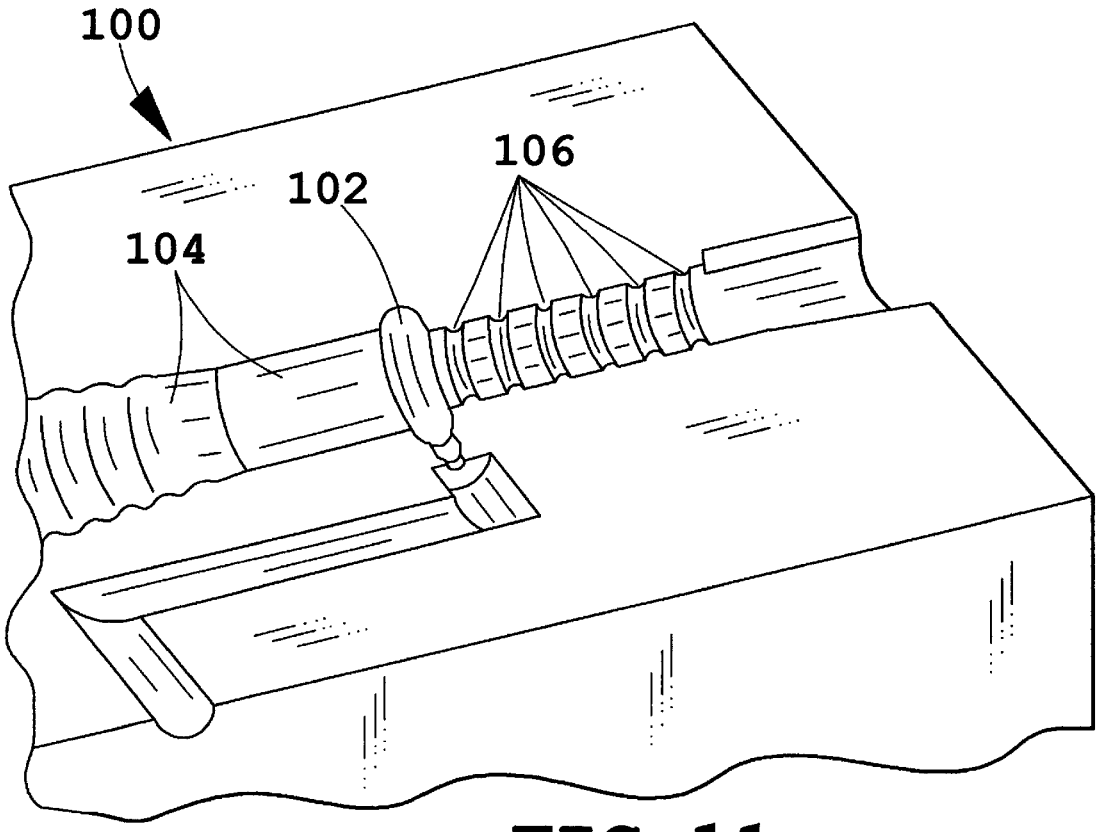
FIG. 11 is an enlarged fragmentary perspective view showing features of the mold half shown in FIG. 10.

Due to the pressure under which the molding material is forced into all of these areas and their adjacent voids, the molding material should be introduced from a location near the end of mold 100 which is adjacent cable 74, rather than from a location near the floor 34 (or through the latter, from cavity 48), and the molding pressure etc., controlled, since otherwise there may be some resulting disruption of the interconnected spade connectors 78, 92 inside backshell 36. Furthermore, due to the comparatively large volume of the space in the area of the conductors 76 and connectors 78, 92, compared to the space around the outer sheath of cable 74, the latter area could become only partially filled with molding material before such material begins to set up. To prevent this, the injection mold should have an annular racetrack 102 (FIG. 11) at the end of the pocket 104 nearest cable 74. The annular racetrack 102 forms an annular bead 75 of the molding material around the circumference of the overmold 81 at an end thereof distal the backshell 36 (FIG. 10). The annular racetrack 102 provides a void which improves the flow of the PVC into that part of the injection mold at the onset of injection. While it is desirable (as point out above) to introduce the molding material from a point distal the backshell 36, without the racetrack 102 the molding material tends to rapidly flow toward the backshell 36, without first fully encapsulating the cable 74. This would result in trapped air and an unfilled or insufficiently filled area known as a void in the area of cable 74. If the molding material is injected at a high pressure in order to eject such trapped air and fill the area otherwise voided, the high pressure may break the contact 86 away from the terminal 78. The racetrack 102 allows the molding material to surround the cable 74 before flowing up toward the backshell 36. The preferred PVC overmold material is preferably injected at a pressure of about 500 psi and a temperature of about 370° to about 400° F. The injection mold 100 preferably has ridges 106 around the outside of cable 74 (FIG. 11) for gripping the cable and holding it in place during the injection of the overmold material from the cable toward the backshell.

It is to be pointed out once again that while the foregoing disclosure addresses a particular preferred embodiment, and best mode, the particular apparatus described and the various detailed aspects thereof noted are regarded as pertaining to only the most preferred version of the invention and to merely illustrate the principles and concepts involved in the invention, other embodiments, and versions of the invention no doubt being feasible and potentially appropriate in other circumstances. A simple example of one such variation is the smoothly conical shape of overmold 81 shown in FIGS. 1, 3, and 6, as contrasted with the circumferentially ribbed version shown in FIG. 10, (which may be considered the preferred embodiment). It should therefore be understood that the foregoing description of a particular preferred embodiment is provided for purposes and illustration, and not as a measure of the invention, whose scope is to be defined solely by reference to the ensuing claims. Embodiments of the invention differing from those set forth above which nonetheless utilize the underlying concepts of the invention and incorporate its spirit should therefore be considered as within the scope of the claims appended below, unless such claims by their language specifically state otherwise.

The claimed invention is:

1. An environmentally protected connector member for sealed attachment to a cable having a plurality of electrical conductors which are terminated at an end thereof with a contact, said connector member comprising one of a pair of releasably interconnectable coupling components and including:

a housing having a floor, said floor having a plurality of apertures therethrough arranged in a predetermined pattern;

a backshell extending from said floor of said housing and encompassing the extended axes of said apertures, said backshell having at least one bead portion protruding from an outer surface of said backshell and extending at least partially therearound;

a plurality of electrical contacts within said housing, each of said electrical contacts releasably engageable with a corresponding electrical contact of another of said coupling components which is releasably interconnected to said connector member and having a portion extending through one of said apertures and slidably mateable with the said contact terminating one of said electrical conductors;

a locking member for retaining said electrical contacts in a fixed relationship to said floor;

an overmold extending from and molded directly about an exterior of said backshell, to couple the overmold and backshell together, a portion of said overmold engaging said bead in retaining relationship to augment the connection between said overmold and said backshell, said overmold encompassing an exterior of said cable of electrical conductors.

2. The environmentally protected connector of claim 1 including:

an outer backshell encompassing the extended axes of all of said apertures; and an inner backshell disposed within said outer backshell, said inner backshell encompassing the extended axis of at least one of said apertures but less than all of the extended axes of said apertures to separate and generally isolate said at least one of said apertures from others of said apertures.

3. The environmentally protected connector of claim 2 further comprising:

a plurality of ribs extending from and substantially perpendicular to said floor, each of said ribs having an edge disposed adjacent an edge of one of said apertures for maintaining the position of a contact extending through said one of said apertures substantially perpendicular to said floor.

4. The environmentally protected connector of claim 3 wherein:

substantially all of said apertures has at least a first and a second of said rib edges adjacent thereto, and further wherein said first rib edge is disposed adjacent one side of its associated aperture and said second rib edge is disposed adjacent a substantially opposite side of such aperture.

5. The environmentally protected connector of claim 4 wherein:

said first rib edge comprises a pair of laterally disposed rib edges; and said second rib edge comprises a pair of laterally disposed rib edges.

6. The environmentally protected connector of claim 2 wherein:

said inner and said outer backshells are cannularly shaped.

7. The environmentally protected connector of claim 6 wherein:

said inner and said outer backshells are substantially co-axial.

8. The environmentally protected connector of claim 7 wherein:

said less than all of the extended axes of said apertures are annularly disposed between said inner and said outer backshells.

9. The environmentally protected connector of claim 1 wherein:

said housing includes walls extending substantially perpendicular from said floor, said walls in combination with said floor defining a cavity adapted to receive a mating electrical plug, said walls having an upper edge defining the entrance to said cavity.

10. The environmentally protected connector of claim 9 further including:

a cover pivotally mounted to said housing and having a closed position wherein said cover has a portion which abuts said upper edge of said walls.

11. The environmentally protected connector of claim 10 wherein:

said cover includes a resilient member for abutting said upper edge of said walls.

12. The environmentally protected connector of claim 1 1 further including:

a spring for biasing said cover to said closed position.

13. The environmentally protected connector of claim 1 wherein:

said locking member is a tab.

14. The environmentally protected connector of claim 13 wherein:

said tab is attached in cantilevered fashion to said portion of said contact extending through one of said apertures and projects outwardly from said extending portion of said contact, and further wherein said tab is disposed therealong such that a free end of said tab abuts a surface of said floor to maintain said contact in a closely held relationship with respect to said floor.

15. The environmentally protected connector of claim 14 wherein:

said tab is substantially centered in said extending portion of said contact.

16. The environmentally protected connector of claim 1, wherein:

the overmold fills all of the voids within the backshell and between the backshell and the cable.

17. The environmentally protected connector of claim 1, wherein:

the overmold includes a bead around the circumference of the overmold at an end distal the backshell.

18. A connector shell and attachment member for connection to a cable having a plurality of electrical conductors, said connector shell comprising:

a housing having a floor, said floor having a plurality of apertures therethrough arranged in a predetermined pattern, said apertures adapted to receive electrical contacts therethrough;

a backshell extending from said floor of said housing and encompassing the extended axes of said apertures, said backshell having at least one bead portion protruding from an outer surface of said backshell and extending at least partially therearound; and said attachment member comprising an overmold extending from and molded about an exterior of said backshelf, to couple the overmold and backshell together, a portion of said overmold engaging said bead portion in retaining relationship to augment the connection between said overmold and said backshell, said overmold having a size and shape to encompass and be secured to an exterior of said cable having a plurality of electrical conductors.

19. The connector shell of claim 18 further comprising:

a plurality of ribs extending from and disposed substantially perpendicular to said floor, each of said ribs having an edge substantially coincident with an edge of one of said apertures for maintaining a contact extending through said one of said apertures in a position substantially perpendicular to said floor.

20. The connector shell of claim 19 wherein:

each of said apertures has at least a first and a second of said rib edges adjacent thereto and further wherein said first rib edge is disposed adjacent one side of said aperture and said second rib edge is disposed adjacent a substantially opposite side of said aperture.

21. The connector shell of claim 20 wherein:

said backshell is cannularly shaped.

22. The connector shell of claim 18 wherein:

said housing includes walls extending substantially perpendicular from said floor, said walls in combination with said floor defining a cavity adapted to receive a mating electrical plug, said walls having an upper edge defining the entrance to said cavity.

23. The connector shell of claim 22 further:

including a cover pivotally mounted to said housing and having a closed position wherein a surface of said cover abuts said upper edge of said walls.

24. The connector shell of claim 23 wherein:

said cover further includes a resilient member affixed to said surface of said cover for abutting said upper edge of said walls.

25. The connector shell of claim 18, wherein:

the overmold includes a bead around the circumference of the overmold at an end distal the backshell.

26. An environmentally protected connector for substantially sealed attachment to a cable having a plurality of electrical conductors, each conductor terminated at an end thereof with contact, said connector comprising:

a housing having a floor and walls with an upper edge, said walls defining a central cavity, said upper edge defining an opening to said cavity, and said floor having a plurality of apertures therethrough arranged in a predetermined pattern;

a flange extending laterally from said walls proximate to and projecting over portions of said upper edge to hood such portions;

a cover for closing said cavity opening, said cover pivotally mounted adjacent to and at least partially underlying said flange to be hooded thereby at its axis of pivotal mounting;

a biasing member cooperating with said housing and said cover to bias said cover toward a closed position;

a seal carried by said cover to be biased against said upper edge when said cover is in said closed position;

a backshell extending from said floor of said housing and encompassing the extended axes of said apertures;

a plurality of electrical contacts within said housing, each of said electrical contacts having a portion extending through one of said apertures and connected to one of the electrical conductors, said portion having a locking member for retaining its respective one of said contacts in a fixed relationship to its corresponding one of said apertures; and an overmold extending at least from said bead of said backshell to an exterior of the cable and encompassing the electrical conductors thereof, for shielding said contacts and the conductors from the environment.

27. The environmentally protected connector of claim 26, wherein:

the overmold includes a bead around the circumference of the overmold at an end distal the backshell.

28. An environmentally protected connector for attachment to a cable having a plurality of electrical conductors, each conductor terminated at an end thereof with a contact, said connector comprising:

a housing having a floor and walls with an upper edge, said walls defining a central cavity, said upper edge defining an opening to said cavity, and said floor having a plurality of apertures therethrough in a predetermined pattern;

a flange extending laterally from said walls proximate to said upper edge;

a cover for enclosing said cavity opening, said cover pivotally mounted to said housing adjacent said flange;

a biasing member cooperating with said housing and said cover to bias said cover toward a closed position;

a backshell extending from said floor of said housing and encompassing the extended axes of said apertures, said backshell having at least one bead portion protruding from an outer surface of said backshell and extending at least partially therearound;

a plurality of electrical contacts within said housing, each of said electrical contacts having a portion extending through one of said apertures and mated to one of the electrical conductors, said portion having a locking member for retaining its respective one of said contacts in a fixed relationship to its corresponding one of said apertures; and an overmold molded onto said backshell and extending from said at least one bead of said backshell to an exterior of a cable to surround said electrical conductors.

29. The environmentally protected connector of claim 26, wherein:

the overmold includes a bead around the circumference of the overmold at an end distal the backshell.

* * * * *